United States Patent [19]

Haller

[11] 4,237,851

[45] Dec. 9, 1980

[54] PORTABLE BALL THROWING MACHINE WITH ONE-WAY CLUTCH

[75] Inventor: Jacob S. Haller, Northbrook, Ill.

[73] Assignee: Rallymaster, Inc., Elk Grove Village, Ill.

[21] Appl. No.: 59,984

[22] Filed: Jul. 23, 1979

[51] Int. Cl.[3] ..... F41B 7/00

[52] U.S. Cl. ..... 124/16; 273/26 D; 124/41 R; 124/36

[58] Field of Search ..... 124/16, 36, 41 R, 49, 124/7, 41 B; 273/26 D

[56] References Cited

U.S. PATENT DOCUMENTS

| | | | |
|---|---|---|---|
| 3,252,453 | 5/1966 | Giovagnoli | 124/7 |
| 3,640,262 | 2/1972 | Hunsicker | 124/7 |
| 4,185,608 | 1/1980 | Young et al. | 124/16 |

*Primary Examiner*—Richard C. Pinkham
*Assistant Examiner*—William R. Browne
*Attorney, Agent, or Firm*—McDougall, Hersh & Scott

[57] ABSTRACT

A ball throwing machine suitable for battery operation is disclosed. Balls are supplied from a helical ball track to a firing track. A ball striker is cocked by a motor against the force of an adjustable spring. When the striker is positioned over-center the striker rapidly rotates striking the ball. A one-way clutch mechanism is included in the gear train between the motor and ball striker so that the kinetic energy remaining after the ball is launched is utilized to begin cocking the striker for the next cycle of operation. This results in significant reduction in the electrical energy required to operate the mechanism. An elevation control permits selective positioning of the firing track relative to the ball striker.

12 Claims, 11 Drawing Figures

PORTABLE BALL THROWING MACHINE WITH ONE-WAY CLUTCH

BACKGROUND OF THE INVENTION

This invention relates to the field of ball throwing machines. More specifically, it relates to a class of machines for projecting tennis ball and the like on a selected trajectory so that the players may practice.

Tennis ball throwing machines are known and, for example, see the references cited in the prior art statement. Most such devices require a source of house current to operate the electric motor utilized for driving the firing mechanism. This is because the energy necessary to repeatedly cock and discharge the striking mechanism will quickly wear down a battery operated device. Accordingly, it has not been possible to provide a ball throwing machine which can be used away from a source of house current. Since tennis facilities are usually out of doors and away from power receptacles this has limited the wide use of tennis ball throwing machines by players and instructors.

Although portable machines have been proposed, it has not heretofore been possible to provide a device which is portable, cordless and still capable of extended usage. Nor has it been possible to provide a cordless device which is able to project tennis balls at varying velocities and distances in a manner to simulate volleys from an opponent.

It is accordingly an object of the present invention to provide a cordless portable ball throwing machine.

Another object of the invention is to provide a battery operated ball throwing device which efficiently utilizes the available electrical energy so as to provide prolonged periods of usage before battery replacement or recharge is required.

A further object of the invention is to provide a cordless portable throwing machine which is capable of a full range of velocity and distance adjustments so as to simulate the volleys of an opponent upon a tennis court.

Another object of the invention is to provide a cordless portable ball throwing machine in which the momentum remaining in the striker after a ball is stuck is employed to assist in cocking the striking mechanism thereby to reduce the electrical energy required for each cycle of operation.

Other objects and advantages of the invention will be apparent from the remaining portion of the specification.

PRIOR ART STATEMENT

In accordance with the provisions of 37 CFR 1.97, applicant advises that the following are the closest prior art of which he is aware:

U.S. PATENTS

U.S. Pat. Nos. 2,815,743 to Brunderman; 3,128,752 to Andersen; 3,272,194 to Egbert; and 3,610,223 to Green.

PRIOR INVENTION

Applicant acknowledges that the invention disclosed in patent application Ser. No. 840,753, now U.S. Pat. No. 4,168,695 filed Oct. 11, 1977, and assigned to a common assignee, is prior art with respect to the present invention.

Brunderman discloses a ball throwing device for baseballs employing a motor driven spring tensioned ejection mechanism. A damping element is employed to dissipate residual kinetic energy after ejectment of a ball.

Andersen employs an arm 17, cocked by means of a motor 13. A cammed arrangement is utilized to release the throwing arm. The residual kinetic energy in the arm is absorbed by means of shock absorber 37.

Egbert employs a throwing arm 83 which is tensioned by a motor 39 against the bias of spring 93. After striking a ball the arm engages a stop block 101 having a rubber cushion 103 to absorb the residual kinetic energy in the arm.

Green employs a spring loaded striker and pin release assembly. After striking the ball the striker engages a cushion 63 mounted on a damper air cylinder 64 to dissipate its residual kinetic energy.

The invention disclosed in the aforementioned patent application Ser. No. 840,753 employs a striker tensioned by a motor against the resistance of a torsion spring. After striking the ball the striker 104 engages a bumper 114 dissipating the residual kinetic energy in the striker.

DETAILED DESCRIPTION

Figure 1:
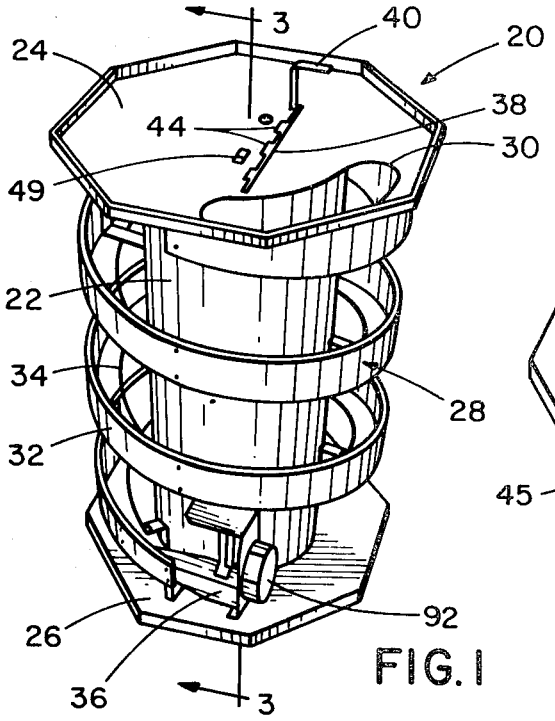
FIG. 1 is a perspective view of a ball throwing machine according to a preferred embodiment of the invention.
Figure 2:
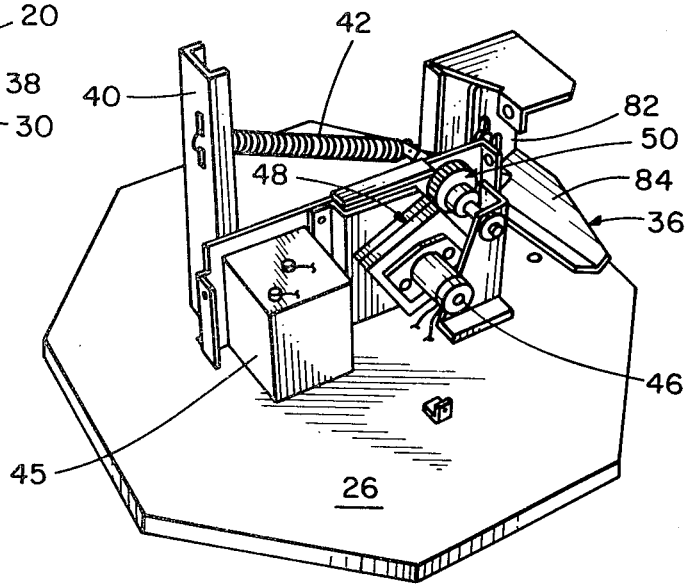
FIG. 2 is a perspective view of the base and throwing mechanism in accordance with the invention.
Figure 3:
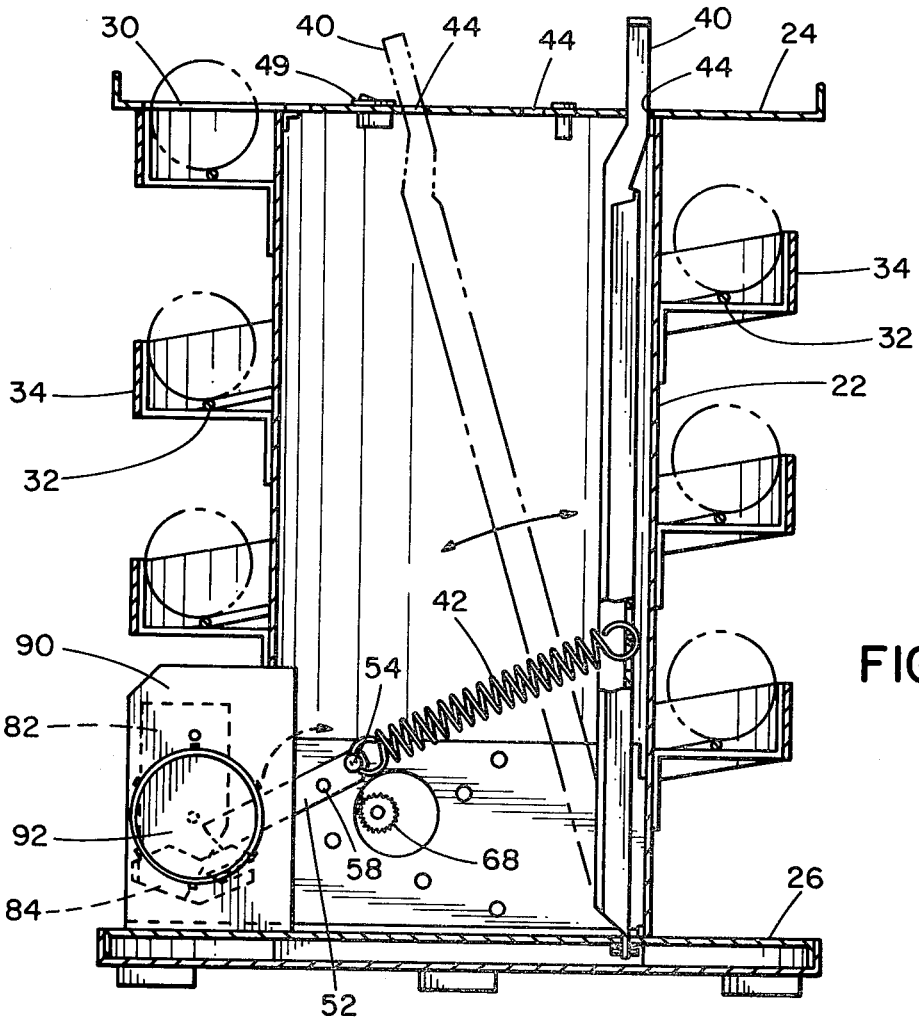
FIG. 3 is a vertical section along the lines 3—3 of FIG. 1.

Referring to the drawings and particularly FIGS. 1 through 3, the invention according to a preferred embodiment is illustrated. The ball throwing machine is ideally suited for projecting tennis balls and this description will refer to that use. It will be recognized, however, that the device can be readily adapted to project balls utilized in other sports activities as, for example, racketball, squash, handball, and the like.

The ball throwing machine 20 includes a tubular housing 22 open at either end thereof. The top of the housing is covered by a top plate 24 while the bottom is secured to a base 26. Concentrically positioned about the tubular housing is a ball track 28 arranged in a helix whereby balls are conveyed from the top plate, around the housing to the vicinity of the base 26. An opening 30 in the top plate permits access to the ball track by which balls can be loaded thereon.

As seen in FIG. 3, the ball track consists of an outer fence 32 in conjunction with a ball support rail 34. As the balls are placed into the opening in the top plate they travel helically, by force of gravity, around the ball track until they reach a ball firing track 36 secured to the base 26. In the case of tennis balls, approximately 50 or more balls can be stored on the ball track in a typical embodiment of the invention. This permits long periods of operation without the need to reload.

Projecting upwardly through an elongated slot 38 in the top plate is an adjusting lever 40 for controlling the tension applied to the striking mechanism by a tension spring 42. The lever 40 can be secured in a plurality of positions along the length of the slot 38 by means of cutouts 44 into which the lever can be captured. As indicated in FIG. 3, movement of the lever along the length of the slot 38 is effective for increasing or decreasing the tension on spring 42 as desired.

Figure 4:
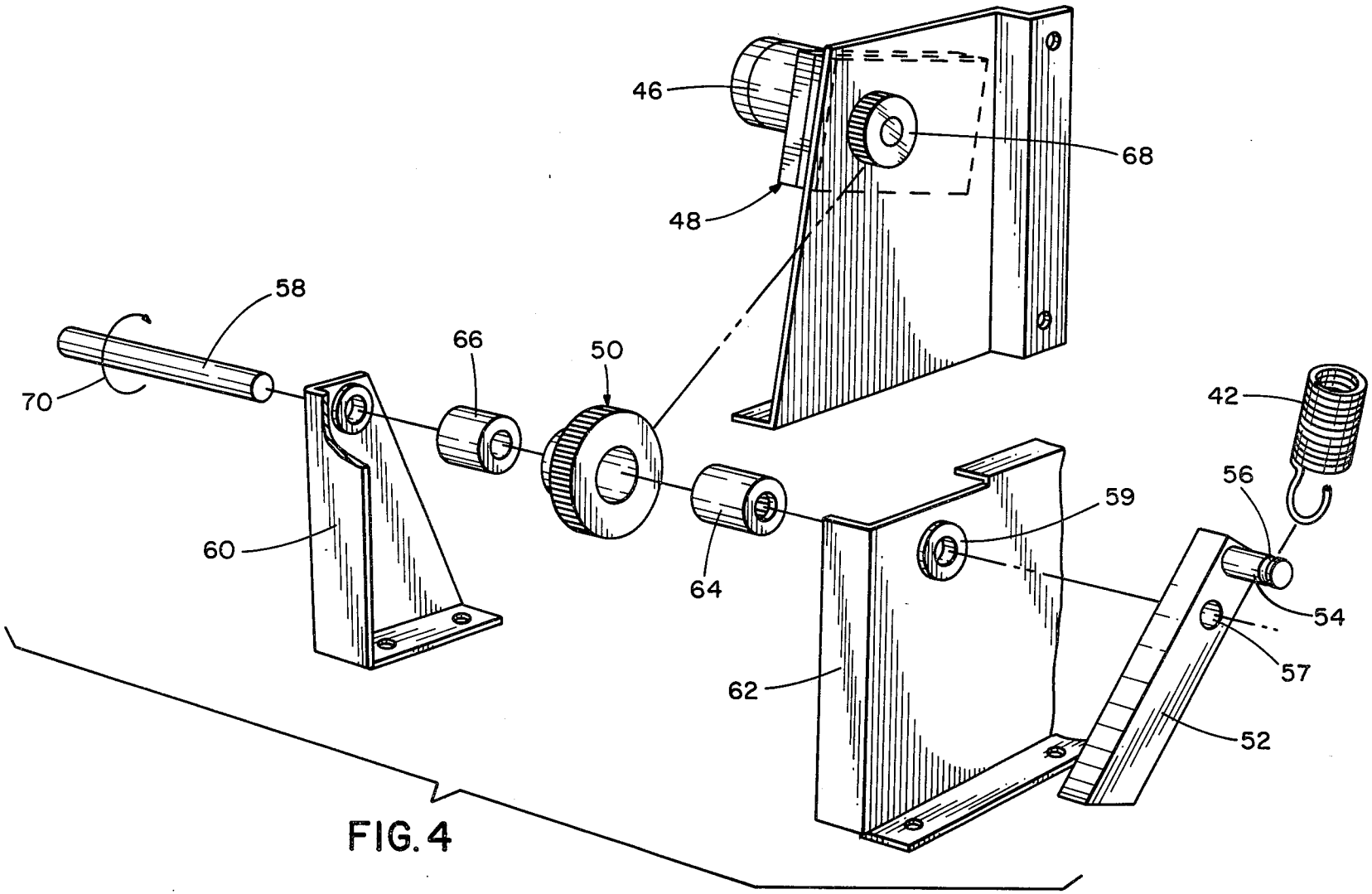
FIG. 4 is an exploded view of the ball throwing mechanism illustrating the details thereof.
Figure 5:
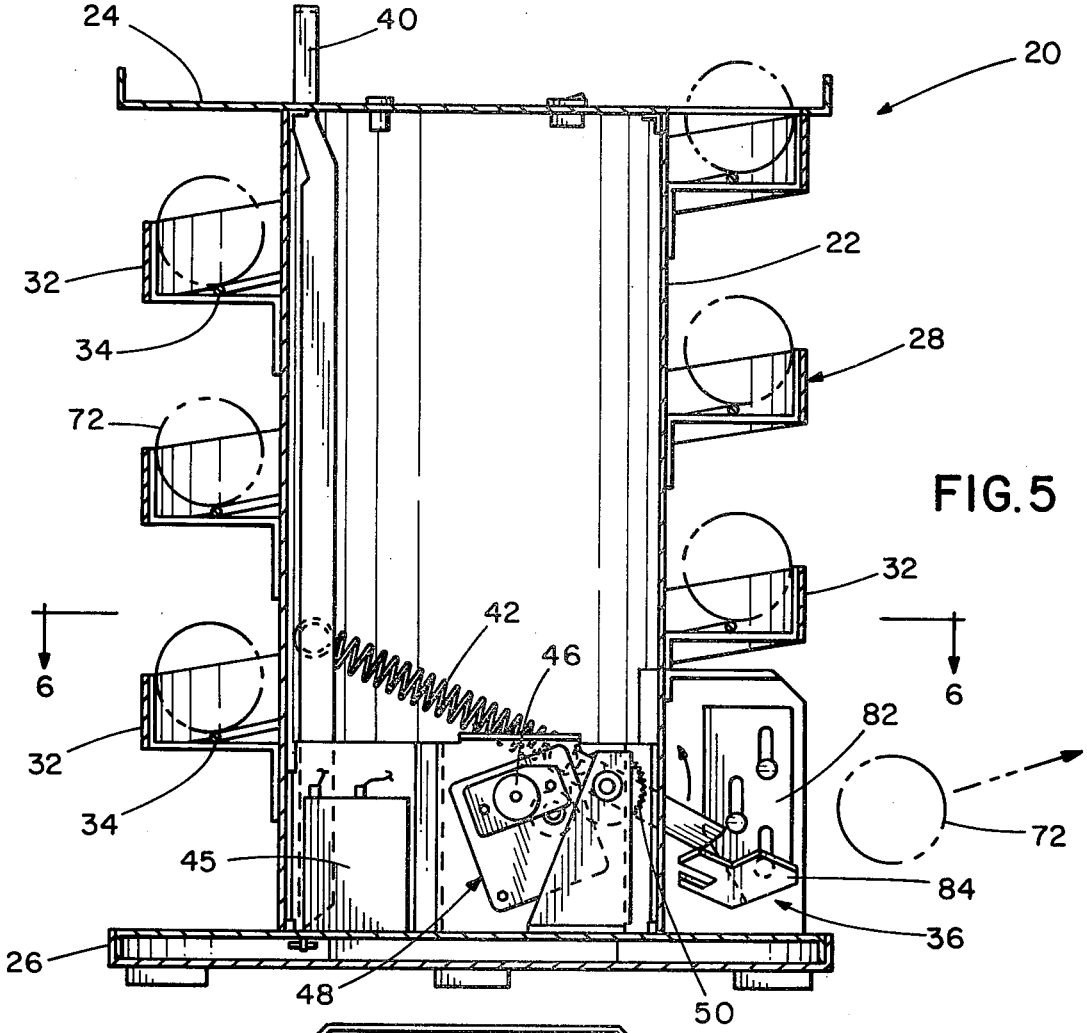
FIG. 5 is a view similar to FIG. 3 looking in the opposite direction.

Referring to FIGS. 2 and 4, the ball firing mechanism is illustrated. The mechanism is battery powered, preferably by means of rechargeable batteries. A representative battery is shown at 45 secured to the base 26. The battery may be electrically connected to a jack located in the top plate for periodic connection to an AC source whereby the battery may be recharged in a conventional manner. The battery is also connected to a small electric motor 46. One side of the circuit between the battery and the motor is connected via a switch 49 mounted on the top plate 24 permitting selective energization of the motor. Electric motor 46 is connected to a gear reducer assembly 48, the output of which drives a gear and clutch assembly 50 in a manner to be described.

The balls are projected from the machine by means of a ball striker 52 which, preferably, consists of a solid metal bar. Mounted at one end of the striker is a spring post 54 having a channel 56 thereon to receive and secure one end of the coil spring 42. The striker is provided with a circular bore 57 located inwardly of the spring post as illustrated in FIG. 4.

The projecting means includes a shaft 58 mounted for rotation between a pair of frame members 60 and 62 secured to the base 26. One end of the shaft 58 passes through a sleeve 59 and is received in the striker bore hole 56 and secured thereto. This may be accomplished by means of a set screw, welding, pressfit, or other appropriate techniques. Concentrically mounted on the mid-portion of shaft 58 is the gear and one way clutch mechanism 50. Spacers 64 and 66 may be provided, as necessary, to correctly position the gear 50 relative to a drive gear 68 associated with the gear reducer mechanism 48.

In the assembled condition gear 68 drivingly engages gear 50 thereby rotating shaft 58 and striker 56. The ball striker 52 is positioned outside the frame member 62 while the gear 50 and the spacers, if any, are positioned on the shaft between the frame members 60 and 62. The gear and one way clutch mechanism 50 is a type commercially available as, for example, part No. RCB-061014FS manufactured by The Torrington Company of Torrington, Conn.

As is known by those skilled in the art, such a clutch mechanism permits free movement of a shaft as, for example, shaft 58, in one direction only. During the operation of the ball throwing mechanism the motor 46 is operated for the purpose of driving the shaft 58 in the direction in which the clutch permits. With reference to FIG. 4, arrow 70 indicates the direction of rotation of the shaft. Because of the presence of the one way clutch, shaft 58 is free to rotate in the indicated direction driven by the motor 46 or from the energy of the ball striker when the spring tension is released in a manner to be described. The clutch mechanism will not permit movement of the shaft and, consequently, the ball striker attached thereto in the reverse direction and this results in an advantageous mode of operation wherein the energy requirements of the invention are significantly reduced.

Figure 8:
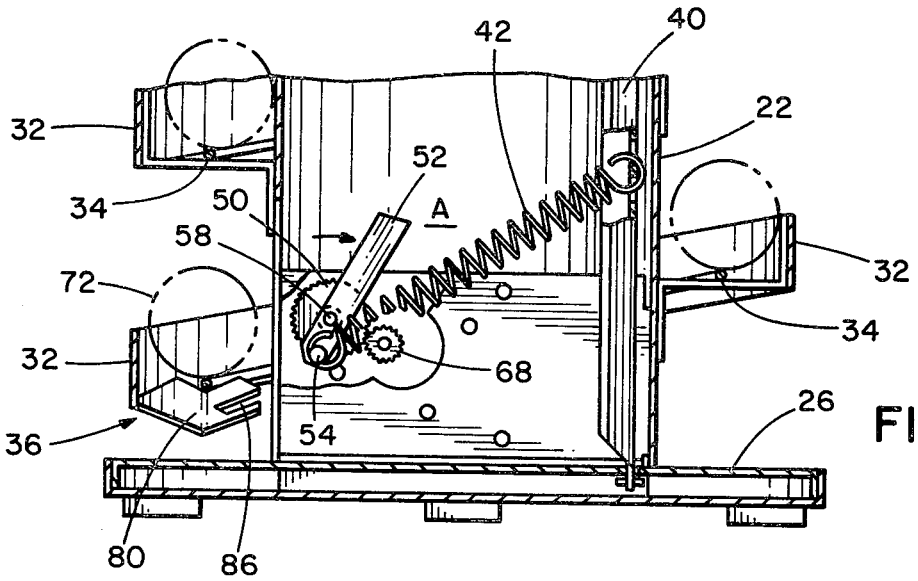
FIGS. 8 and 9 are partial sectional views illustrating the movement of the ball striker through a cycle of operation.
Figure 9:
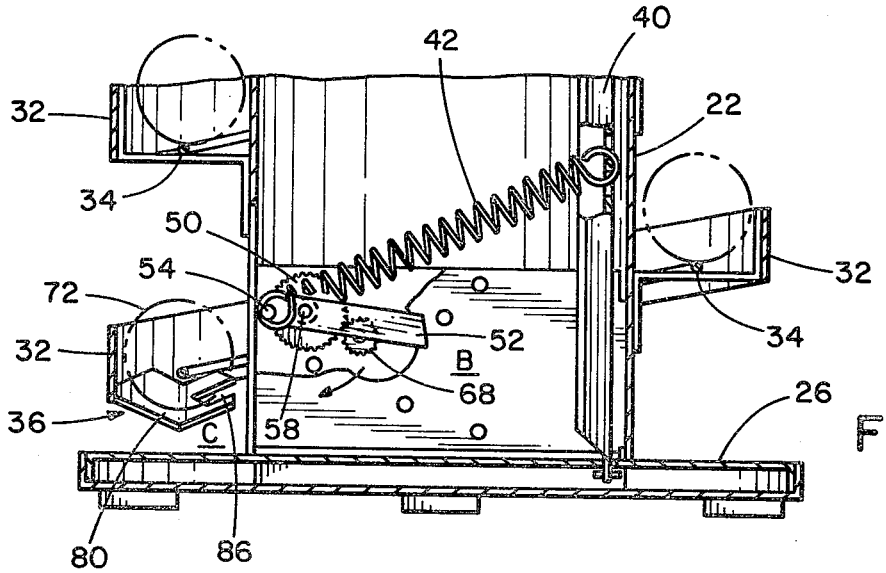

With reference to FIGS. 8 and 9, the advantageous operation of the throwing mechanism will be explained. Assuming that the motor is switched on with the striker in the position A illustrated in FIG. 8, it can be seen that the battery operated motor 46 must move the striker in the direction indicated by the arrow against the tension created by the coil spring 42. It will be recalled that one end of the spring is secured to a spring post 54 while the other end of the spring is secured to the tension lever 40. As the rotation of the striker proceeds the tension of the spring increases until the striker reaches a position approximately as indicated at B in FIG. 9. At this point in the cycle the spring post 54 is "over-center" relative to the shaft 58 on which the striker 52 is mounted. This causes the tension in spring 42 to rapidly rotate the free end of the striker through an arc which passes through the location at which a ball to be struck is located. (The ball position is indicated in phantom at 72 in FIG. 9.)

During this portion of the operating cycle the spring tension drives the shaft 58 at an angular velocity greatly in excess of the speed at which the motor 46 is driving the gear 50. The shaft, however, is free of any drag from the motor by virtue of the one way gear and clutch mechanism 50.

After the striker mechanism has contacted the ball (at point C) and caused ejection thereof a substantial amount of kinetic energy remains in the striker. In the present invention this kinetic energy is advantageously used to reduce the amount of electrical energy required to cock the striker in preparation for the next ball ejectment. As the striker rotates past the impact point it begins to tension the spring 42. Tensioning of spring 42 quickly reduces the kinetic energy in the striker to zero and in the absence of the one-way clutch mechanism 50 damped oscillating movement of the striker would result until an equilibrium position were reached. In the present invention, however, the one-way clutch mechanism prevents any reverse movement of the striker (counterclockwise as viewed in FIGS. 8 and 9). Thus, the striker is maintained at the furthest point it has reached after "over-center" release. This point is approximately located at A in FIG. 8. The striker is held at point A until the motor "catches up" and causes the gear 50 to again rotate the shaft moving the striker from position A to position B for the next "over-center" release.

As will be appreciated by those skilled in the art, this arrangement makes maximum utilization of the energy provided by the motor. Energy from the motor is needed to tension the spring only during movement of the striker between points A and B. The potential energy in the spring is then used to cause the striker to eject balls from the machine. The remaining kinetic energy after striking is utilized to begin cocking the striker for the next cycle of operation. This arrangement is very efficient as compared with existing devices and significantly reduces energy waste.

This highly efficient arrangement results in the ability to provide portable battery operation of the device for extended periods of time. In use, up to five hours of operation can be obtained without recharging the batteries. Because of the low energy usage it is even possible to employ a solar panel (mounted on the top plate) in conjunction with the device in which case the operating period can be extended indefinitely, solely as a function of the available sunlight.

Figure 6:
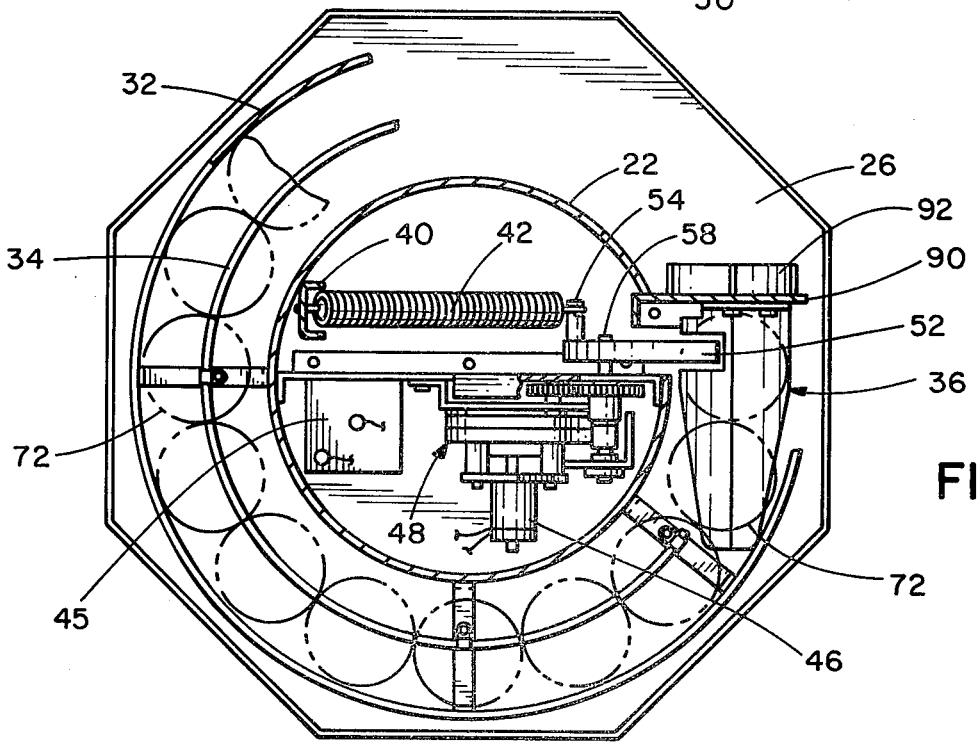
FIG. 6 is a sectional view along the lines 6—6 of FIG. 5.
Figure 7:
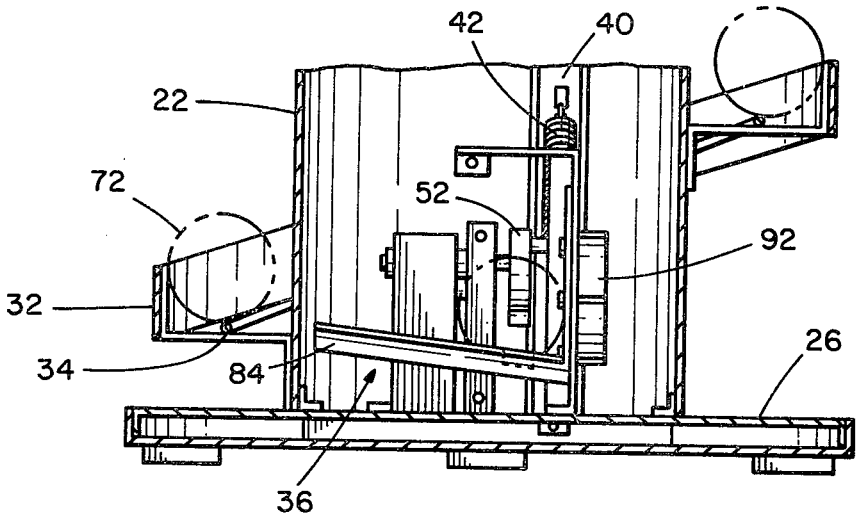
FIG. 7 is a partial vertical section illustrating the relationship between the ball track and the firing track.

Referring now to FIGS. 6, 7, 10 and 11, the construction and operation of the ball firing track will be described. The firing track 36 consists of a ramp portion 80 connected to a vertical flange 82. The rear portion of the ramp includes an upwardly deflected section 84 having a notch or opening 86 therealong. As can be seen in FIG. 6, the notch permits the ball striker 52 to impact a ball positioned on the firing track. The ramp 80 terminates at a point adjacent the end of the ball track and thus balls roll from the ball track onto the ramp serially as each ball is ejected by the striker. The length dimension of the ramp permits two balls at a time to be positioned thereon.

The height of the ramp 80, relative to the base and striker path, affects the trajectory of the ball. In order to permit selection of ball trajectory an elevation control is provided.

Figure 10:
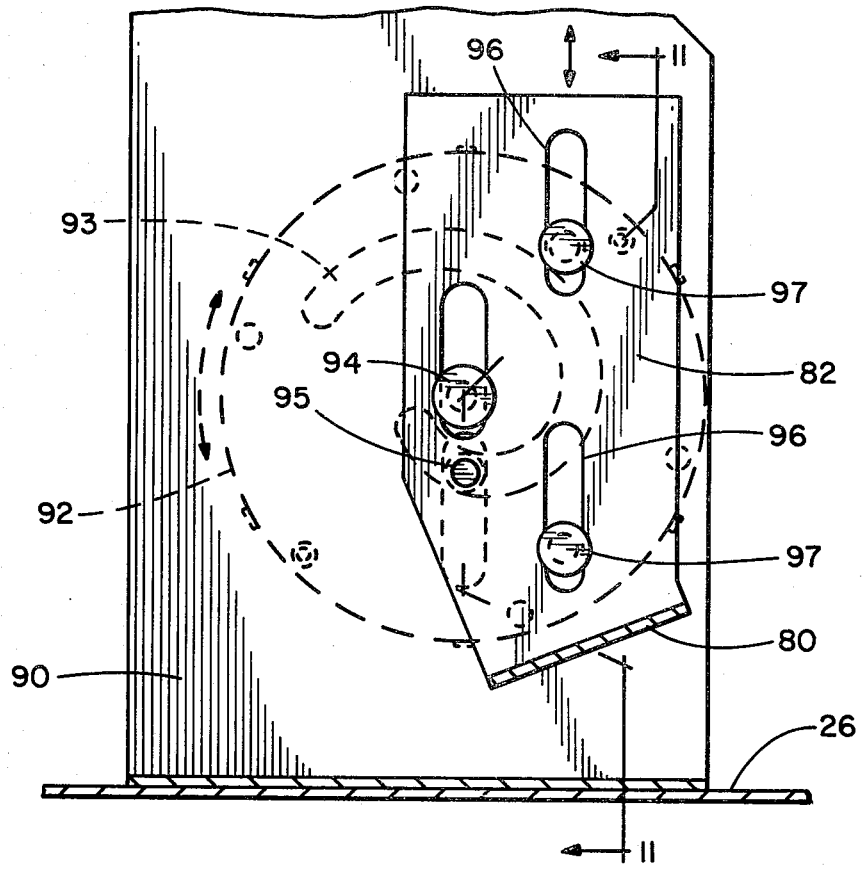
FIG. 10 is a side elevational view of the adjusting mechanism for the firing track.
Figure 11:
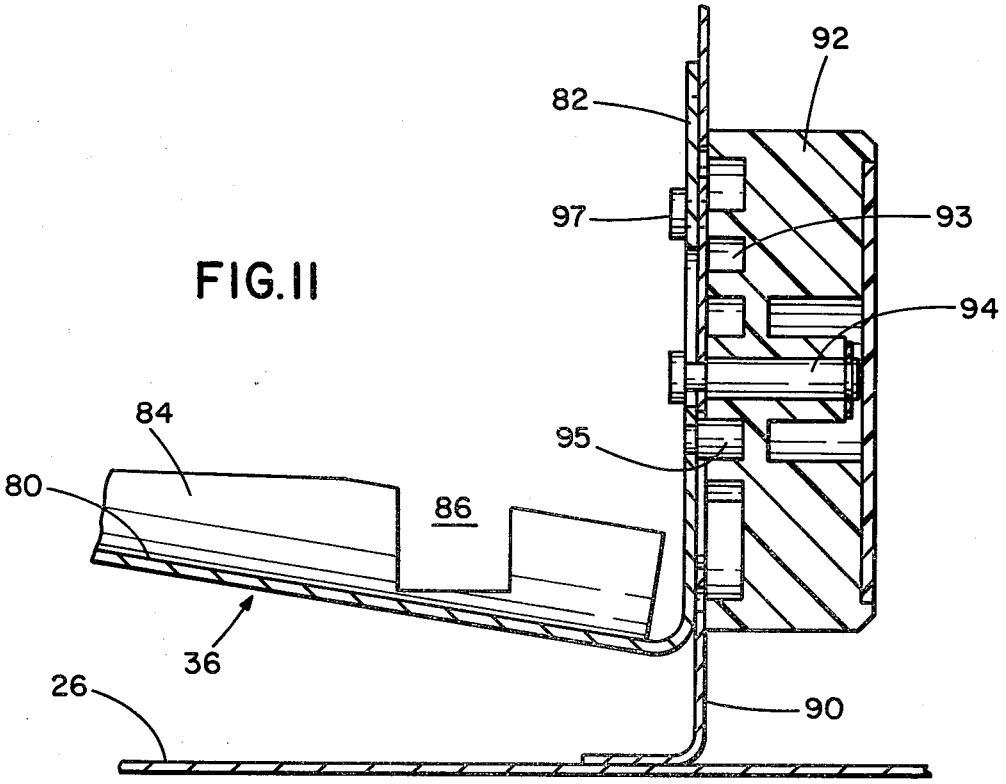
FIG. 11 is a sectional view along the lines 11—11 of FIG. 10.

The elevation of the ball track is controlled by selective positioning of the vertical flange 82 relative to the frame 90. This can be accomplished in a number of ways as, for example, by latching the flange in selected apertures in the frame at a desired position. Alternatively, as illustrated in FIGS. 10 and 11, an elevation knob 92 containing a spiral cam channel 93 can be employed whereby rotation of the knob moves a cam 95 attached to the vertical flange 82 in a desired direction to raise or lower the firing track. Slots 96 in the flange cooperate with retaining members 97 to permit vertical movement while maintaining the flange in abutting relation with frame 90.

From the foregoing, the operation of the invention should be readily apparent. For completeness, however, a brief operating summary will now be provided. After the device is charged it is disconnected from a source of AC current and taken to the location where it is to be utilized. It is then loaded with balls through the top plate opening 30 until the ball track is filled to capacity or as desired. Balls pass from the ball track onto the firing track 36. The elevation of the firing track is set for a desired trajectory and the tension on the spring 42 is set to a desired position to adjust the impact of the ball striker. The machine is then switched on and operation proceeds in an automatic manner.

The DC motor drives the striker to the over-center position B at which point the spring 42 causes a snap action in which the striker impacts the ball ejecting it in the desired manner. The striker then continues on past the point of impact, initiating cocking of the spring for the next cycle of operation. When the kinetic energy in the striker is exhausted, the one-way clutch assembly prevents reverse movement of the spring and holds the striker in the partially cocked position A, FIG. 8, until the motor drive engages and completes cocking the spring to the over-center release point B. During each cycle of operation, as a ball is ejected from the firing track, succeeding balls roll off of the ball track and into position over the aperture 86 in the firing track 36. After a complete set of balls have been fired from the device it is switched off and reloaded as desired.

While I have shown and described embodiments of this invention in some detail, it will be understood that this description and illustrations are offered merely by way of example, and that the invention is to be limited in scope only by the appended claims.

I claim:

1. A portable ball throwing machine comprising:

(a) means on which balls are positioned for launching,
(b) means for supplying balls to said launching means,
(c) means for striking balls positioned on said launching means, said striking means including:
  (i) a ball striker rotatably mounted on a shaft,
  (ii) means for normally biasing said ball striker to a release position,
  (iii) electrical drive means for rotating said striker in a first direction against the force of said biasing means to a fully cocked position, said striker, upon reaching said fully cocked position, rapidly rotating in said first direction toward said release position striking said balls, said drive means including clutch means for permitting said striker to rotate on said shaft in said first direction only, whereby kinetic energy remaining in said striker after striking a ball is utilized to partially cock said striker for the next cycle of operation thereby reducing the energy required from said electrical drive means to rotate said striker to said fully cocked position.

2. A portable ball throwing machine according to claim 1 wherein said launching means is a firing track including means for raising and lowering said track relative to the rotational path of said striker.

3. A portable ball throwing machine according to claim 2 wherein said firing track has an opening permitting said striker to pass therethrough to strike a ball positioned on said track over said opening.

4. A portable ball throwing machine according to claim 1 wherein said supplying means is a helical ball track on which balls roll from the top to the bottom thereof, said launching means being positioned adjacent said bottom to receive balls therefrom.

5. A portable ball throwing machine according to claim 1 wherein said ball striker is an elongated member including means for securing said striker to said shaft, said securing means being located near one end of said striker, the other end of said striker being utilized to strike balls.

6. A portable ball throwing machine according to claim 5 wherein said striker has an attaching means located at said one end, said biasing means being attached thereto.

7. A portable ball throwing machine according to claim 1 wherein said biasing means includes a spring which is tensioned by the rotation of the striker from the release position to the cocked position.

8. A portable ball throwing machine according to claim 7 wherein said biasing means further includes means for adjusting the tension in said spring whereby the force imparted to said striker is selectable.

9. A portable ball throwing machine according to claim 1 wherein said drive means includes: an electric motor drivingly connected to said shaft via said clutch means.

10. A portable ball throwing machine according to claim 9 wherein said motor is battery operated.

11. A portable ball throwing machine according to claim 1 wherein said drive means includes an electric motor, a gear train connecting said motor to said shaft for rotation of the latter, said gear train including said clutch means.

12. A portable ball throwing machine according to claim 1 or claim 9 or claim 11 wherein said clutch means is a one-way clutch permitting both free rotation and driven rotation of said shaft in said first direction while preventing any rotation of said shaft in the direction opposite said first direction.

* * * * *